US005869811A

United States Patent [19]

Benni et al.

[11] Patent Number: 5,869,811

[45] Date of Patent: Feb. 9, 1999

[54] METHOD AND EQUIPMENT FOR BRINGING METAL ALLOY INGOTS, BILLETS AND THE LIKE TO THE SEMISOLID OR SEMILIQUID STATE IN READINESS FOR THIXOTROPIC FORMING

[75] Inventors: Gianni Benni, Calderara Di Reno-Bologna; Giorgio Muneratti, Polesella-Rovigo; William Taddia, Vigarano Mainarda-Ferrara; Romano Bettarelli, S.Maria Maddalena-Rovigo, all of Italy

[73] Assignee: Reynolds Wheels International Ltd., Lugano, Switzerland

[21] Appl. No.: 781,687

[22] Filed: Jan. 10, 1997

Related U.S. Application Data

[62] Division of Ser. No. 531,248, Sep. 20, 1995, Pat. No. 5,665,302.

[30] Foreign Application Priority Data

Sep. 23, 1994 [IT] Italy ..... BO94A0417

[51] Int. Cl.[6] ..... B22C 11/06; F27B 9/10

[52] U.S. Cl. ..... 219/388; 219/400; 432/152; 164/900; 266/87

[58] Field of Search ..... 164/900; 432/152; 373/109; 392/310; 219/388, 390, 400; 266/80, 87, 200, 251, 252, 255, 256, 257, 261

[56] References Cited

U.S. PATENT DOCUMENTS

| | | | |
|---|---|---|---|
| 1,919,650 | 7/1933 | Hagan . | |
| 2,250,868 | 7/1941 | Huff | 266/255 |
| 2,432,239 | 12/1947 | Hoak | 266/255 |
| 4,569,218 | 2/1986 | Baker et al. . | |
| 5,253,596 | 10/1993 | Coraggioso | 110/316 |
| 5,282,910 | 2/1994 | Gabathuler et al. | 148/567 |
| 5,533,562 | 7/1996 | Moschini et al. | 164/900 |
| 5,559,826 | 9/1996 | Ohtani et al. | 373/109 |
| 5,571,346 | 11/1996 | Bergsma | 148/550 |
| 5,704,411 | 1/1998 | Suzuki et al. | 164/900 |

FOREIGN PATENT DOCUMENTS

| | | |
|---|---|---|
| 0 513 523 A1 | 11/1992 | European Pat. Off. . |
| 0 518 815 A1 | 12/1992 | European Pat. Off. . |
| 0 645 206 A1 | 3/1995 | European Pat. Off. . |
| 1 413 661 | 8/1937 | Germany . |
| 1 194 155 | 6/1965 | Germany . |
| 1 817 032 | 7/1970 | Germany . |
| 2 112 676 | 7/1983 | United Kingdom . |
| 2197883 | 6/1988 | United Kingdom . |

OTHER PUBLICATIONS

H. Troger, *Modern Heat–Treating Furnaces with air circulation for copper–base and light alloy sections* (*firing method and air flow problems*), Gas Warme International, vol. 20, No. 10, Oct. 1971, pp. 350–354.

*Primary Examiner*—Teresa J. Walberg
*Assistant Examiner*—Gregory A. Wilson
*Attorney, Agent, or Firm*—Darby & Darby

[57] ABSTRACT

A method by which ingots of thixotropic metal alloy are brought to the semisolid or semiliquid state comprises the steps of introducing the single solid ingots at ambient temperature into a heat chamber, generating air currents within the chamber so that the ingots are heated principally by convection, controlling the temperature of the ingots, and removing them from the chamber once a predetermined temperature has registered and been held steady in the metal alloy for a duration sufficient to induce the semisolid or semiliquid state; the ingots are supported and conveyed through a circular path internally of the heat chamber by a set of radial platforms revolving between an infeed zone and an outfeed zone.

15 Claims, 3 Drawing Sheets

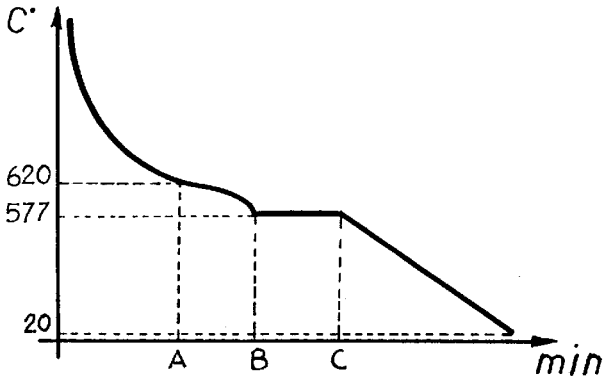
FIG 1
FIG 4
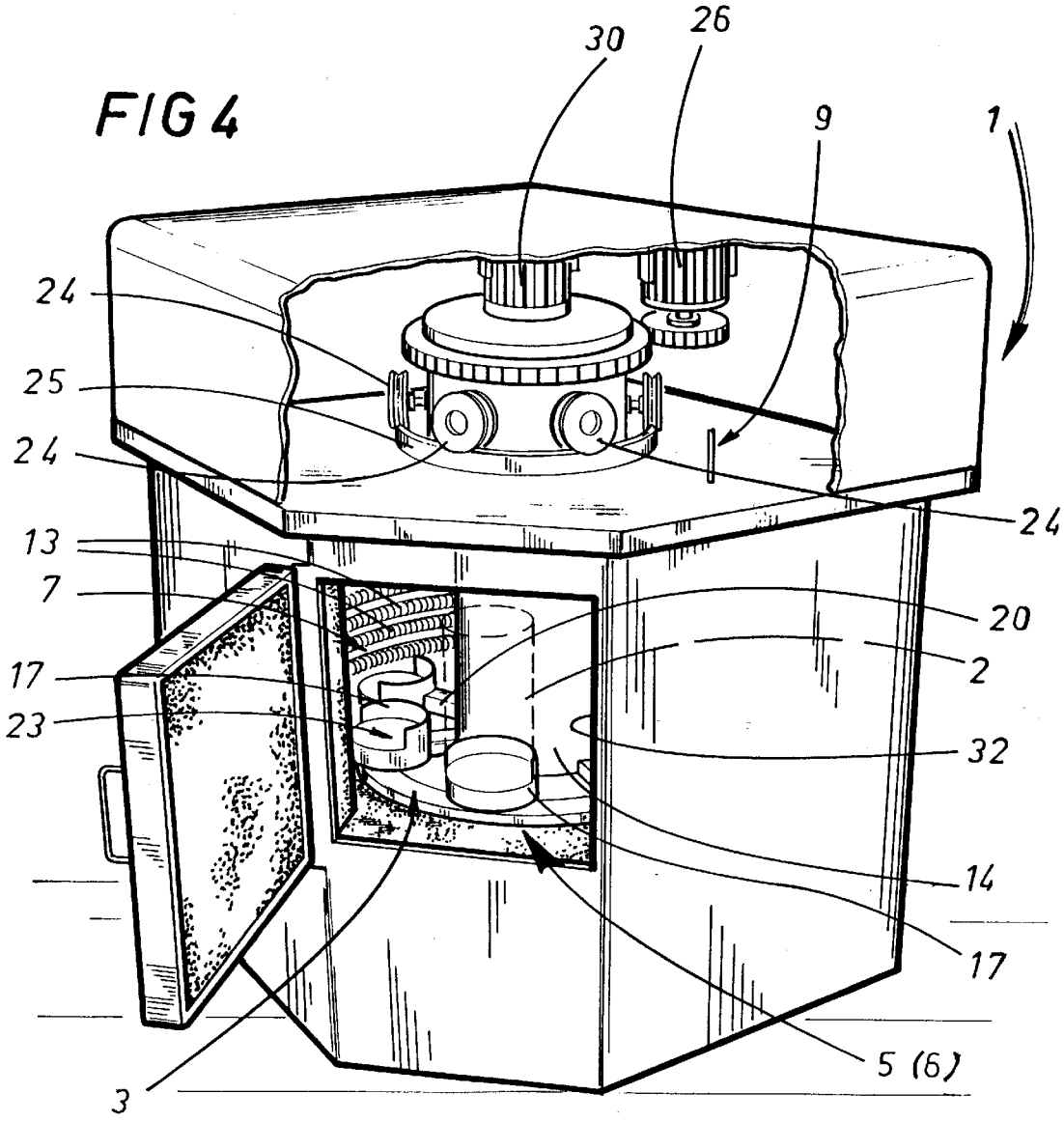

1
27
14
30
26
28
24
25
15
10
4
7
9
13
18
18
33
2
2
19
31
17
23
13
19
3
20
17
8
22
16
23

METHOD AND EQUIPMENT FOR BRINGING METAL ALLOY INGOTS, BILLETS AND THE LIKE TO THE SEMISOLID OR SEMILIQUID STATE IN READINESS FOR THIXOTROPIC FORMING

This is a division, of application Ser. No. 08/531,248, filed Sep. 20, 1995 now U.S. Pat. No. 5,665,302.

BACKGROUND OF THE INVENTION

The present invention relates to a method by which solid metal alloy castings such as ingots, billets and the like destined for thixotropic forming are brought to the semisolid or semiliquid state, also to equipment for its implementation. More exactly, the castings brought to the semisolid or semiliquid state by the equipment in question are alloys of aluminum, magnesium and copper.

A recent addition to the range of processes adopted hitherto for the shaping of metal alloys, typically pressure diecasting, forging, and others, is the method known as thixotropic forming: such a method employs ingots prepared from a metal alloy that is brought to the semisolid or semiliquid state before being shaped and exhibits a particular structure consisting in a homogeneous arrangement of solid crystals, globules or granules immersed in a liquid phase. Accordingly, this particular type of process requires a partial or total fusion of those phases of the alloy with a lower melting point, whilst the globular phases determining the thixotropic nature of the alloy must be maintained in the solid state.

In practice, the resulting structure is composed of solid globules distributed homogeneously within a liquid phase, hence with no dendrites, i.e. devoid of crystals growing arborescently around nuclei.

It is essential that the proportions between solid phase and liquid phase can be reproduced at will in any ingot cast as a thixotropic starting material, compatibly with the type of alloy and the forming process adopted, so as to ensure that the behaviour of the alloy in forming and the specifications of the end product can be maintained constant.

Referring momentarily to the accompanying drawings, the state of a metal alloy suitable for thixotropic forming is indicated schematically by the graph of FIG. 1: the part of the curve to the left of point A represents material entirely in the liquid state, whereas the part to the right of point C represents material entirely in the solid state. The parts of the curve between points A and C indicate semisolid or semiliquid material and, more exactly, the part between B and C represents a material composed of solid crystals or granules or globules immersed in a liquid phase, which is the eutectic. Progressing from point C to point B, the percentage of eutectic in the liquid state as opposed to solid crystals increases from 0 to 100. From point B to point A, on the other hand, it is the percentage of crystals in solid solution passing to the liquid state that increases from 0 to 100. In the case of thixotropic alloys, the areas of interest are generally B-C, where one has solid crystals together with eutectic in the liquid state, and a part of B-A depending on the liquid fraction effectively required.

An ingot of such a material will behave as a solid when simply conveyed or handled, but in the manner of a liquid when subjected to any type of forcible shaping operation.

To reiterate, an ingot in this condition is devoid of dendrites tending to jeopardize its homogeneous composition and mechanical strength, as any person skilled in the art will be aware.

Again referring to FIG. 1, and in particular to the part of the curve between B and C, it will be noted that the mere application of heat is not enough to induce the required semisolid or semiliquid state of the material; in practice, the material must be maintained at the requisite temperature for a given length of time.

Conventionally, an ingot of any given description in the solid state and at ambient temperature is brought to the semisolid or semiliquid state using induction furnaces, the heat produced by generating a magnetic field of which the flux lines directly envelop the ingot. The correct heating action, in terms of obtaining the requisite temperature and maintaining the ingots at this same temperature for the correct duration, will be determined by trial and error, whereupon the conditions which are seen to produce the desired end result must be repeated exactly.

The typical induction furnace consists essentially in a cylindrical crucible accommodating a single ingot and encircled by induction coils disposed in such a manner as to generate a magnetic field with flux lines impinging on and enveloping the ingot. Clearly, any variation in value and frequency of the magnetic field will occasion a corresponding variation in the temperature applied to heat the ingot and a different distribution of heat between the skin and the core of the ingot. By regulating and monitoring the value of the magnetic field in the appropriate manner, the type of heating action applied to the ingot can be controlled selectively, targeting areas further and further in toward the core.

The time taken by such furnaces to bring each ingot to the desired temperature will naturally depend on the diametral dimensions of the material.

For a better illustration of the problem addressed by the present invention, reference may be made to a specific example: to bring an ingot some 150 mm in diameter and 380 mm in height to the semisolid or semiliquid state in the correct manner using an induction furnace of conventional type, a time of approximately 18 minutes is required. This may well be acceptable in an experimental situation, but is certainly not acceptable in a context of industrial scale manufacture.

Considering a production tempo of one ingot per minute as acceptable, a battery of 18 conventional furnaces would be required to achieve such a rate. First of all, there are serious problems of economy associated with the operation of so many furnaces, given their high overall power consumption. What is more, one has the drawback of the considerable bulk exhibited by the equipment, given that an induction furnace able to heat the size of ingot in question will have an external diameter of some 600 mm, to which the dimensions of the electrical panels must also be added. The bulk of the furnace is augmented further by being associated, necessarily, with an automatic or semi-automatic device for changing the ingot. The overall dimensions of the installation could be reduced to a degree by utilizing a single change device serving all the furnaces, though this would lead to notable structural complexities.

The prior art does in fact embrace one particular multiple type of induction furnace albeit designed for use with smaller ingots, smaller in transverse dimensions especially, which comprises a platform rotatable about a vertical axis and supporting a plurality of ingots spaced apart around the axis of rotation at equidistant intervals. Located above the platform is a support capable of movement in the vertical direction and carrying a plurality of open bottomed induction furnaces, the number of the induction furnaces being identical to the number of ingots carried by the platform beneath. The support is designed to alternate between a lowered position in which the induction furnaces each encompass a relative ingot, the open bottom ends engaging in a close fit with the platform, and a raised position in which the platform is able to index through one angular step, corresponding to the distance between any two adjacent ingots. The furnaces are put into operation in such a way that the orbit around the axis of rotation can be divided substantially into three zones of different temperature, including one in which the temperature and the structure of the ingots is rendered uniform.

Not even this special multiple furnace can meet the requirements stated previously, however, inasmuch as a furnace able to heat ingots of the dimensions indicated above would be disqualified by excessive dimensions and similarly excessive operating costs: accordingly, the object of the present invention is to provide a method and equipment by means of which ingots can be heated to the semisolid or semiliquid state both swiftly and at reasonable cost.

SUMMARY OF THE INVENTION

The aforementioned object is realized in a method for bringing ingots or billets of thixotropic metal alloy to the semisolid or semiliquid state, in readiness for forming, which comprises the steps of introducing the ingots into a heat chamber in their solid state and heating the air within the chamber, generating-convectional air currents internally of the enclosure in such a manner that the ingots are heated principally by convection, then controlling the temperature of the ingots and finally removing them from the chamber after being raised to a given temperature which is maintained for a predetermined duration sufficient to induce the semisolid or semiliquid state.

The softening ingots are set in motion within the heat chamber through the agency of conveying and positioning means by which they are supported and advanced from an infeed zone to an outfeed zone.

To advantage, the air internally of the chamber can be heated by means of a fluid fuel burner, which will also serve also to generate the convectional air currents, the heat chamber in this instance affording vents through which to exhaust the fumes emitted by the burner.

Alternatively, the necessary heat can be produced by electrical resistances associated at least with the side walls of the chamber and operating in conjunction with a forced ventilation system, in which case the heat output from the resistances can be proportioned so that the requisite temperature is initially obtained and thereafter maintained along the path followed by the ingots between the infeed and outfeed zones.

The invention also relates to equipment capable of implementing the method for bringing metal alloy ingots to the semisolid or semiliquid state as outlined above: such equipment comprises a heat chamber, and, installed and operating internally of the chamber, conveying and positioning means such as will transfer a plurality of ingots from an infeed zone of the chamber, at which the ingots are introduced in the solid state, to an outfeed zone at which the ingots are removed ultimately in the semisolid or semiliquid state, also heating means operating in conjunction with forced ventilation means internally of the heat chamber in such a way as to generate convectional air currents by which the ingots are enveloped and heated.

The equipment further comprises means by which to sense the temperature of the ingots, connected to a monitoring and control unit of which the functions are to pilot the operation of the conveying and positioning means, the forced ventilation means and the heating means, also to memorize the temperature of the ingots and the rate at which the ingots are advanced through the chamber by the conveying and positioning means.

BRIEF DESCRIPTION OF THE DRAWINGS

The invention will now be described in detail, by way of example, with the aid of the accompanying drawings, in which:

FIG. 1 shows the time-vs-temperature graph relative to a possible metal alloy of thixotropic type such as might be utilized in conjunction with equipment according to the present invention;

FIG. 4 is a perspective view of the equipment as in FIG. 3.

DESCRIPTION OF THE PREFERRED EMBODIMENTS

Figure 2:
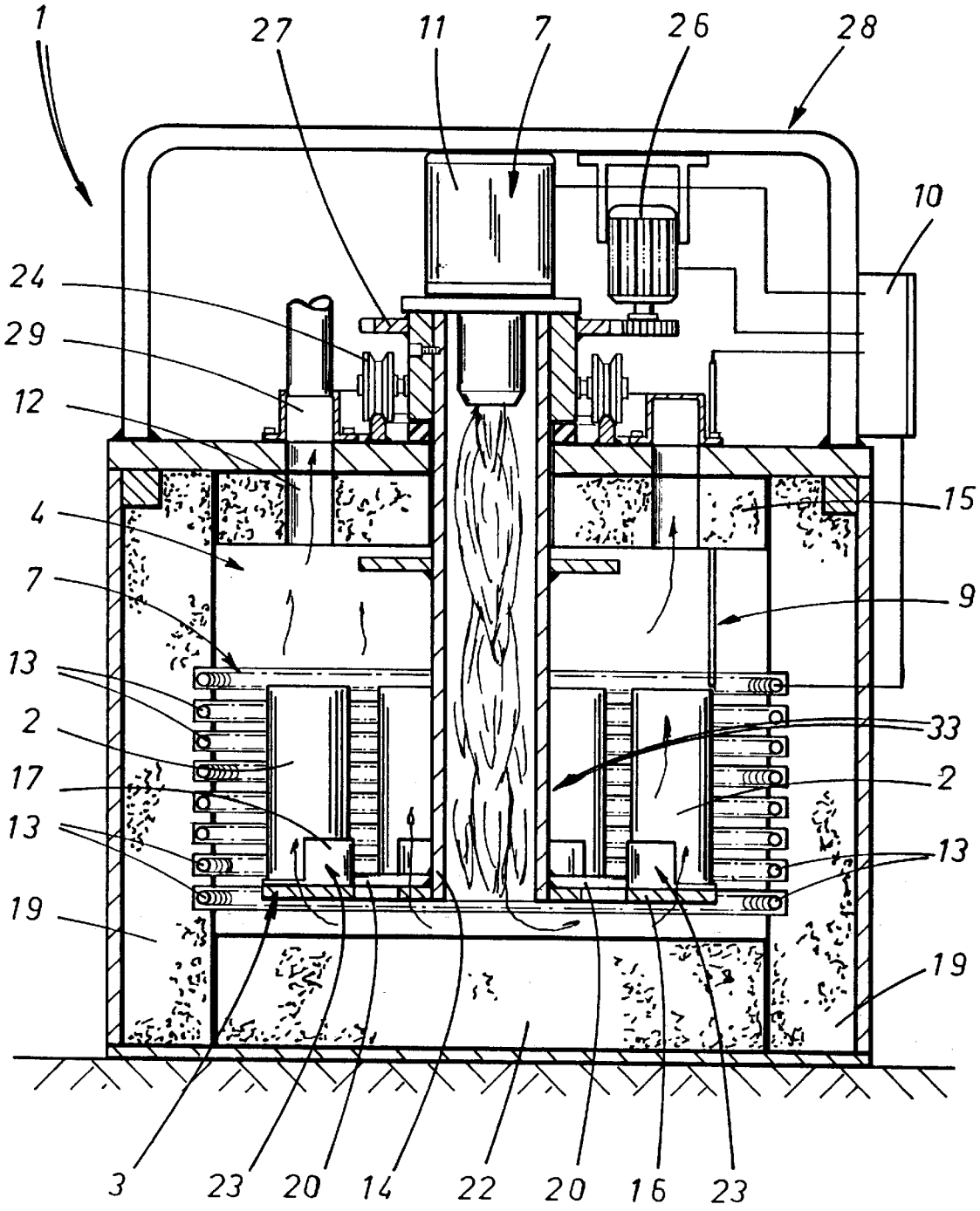
FIG. 2 illustrates the equipment according to the present invention in an axial section.
Figure 3:
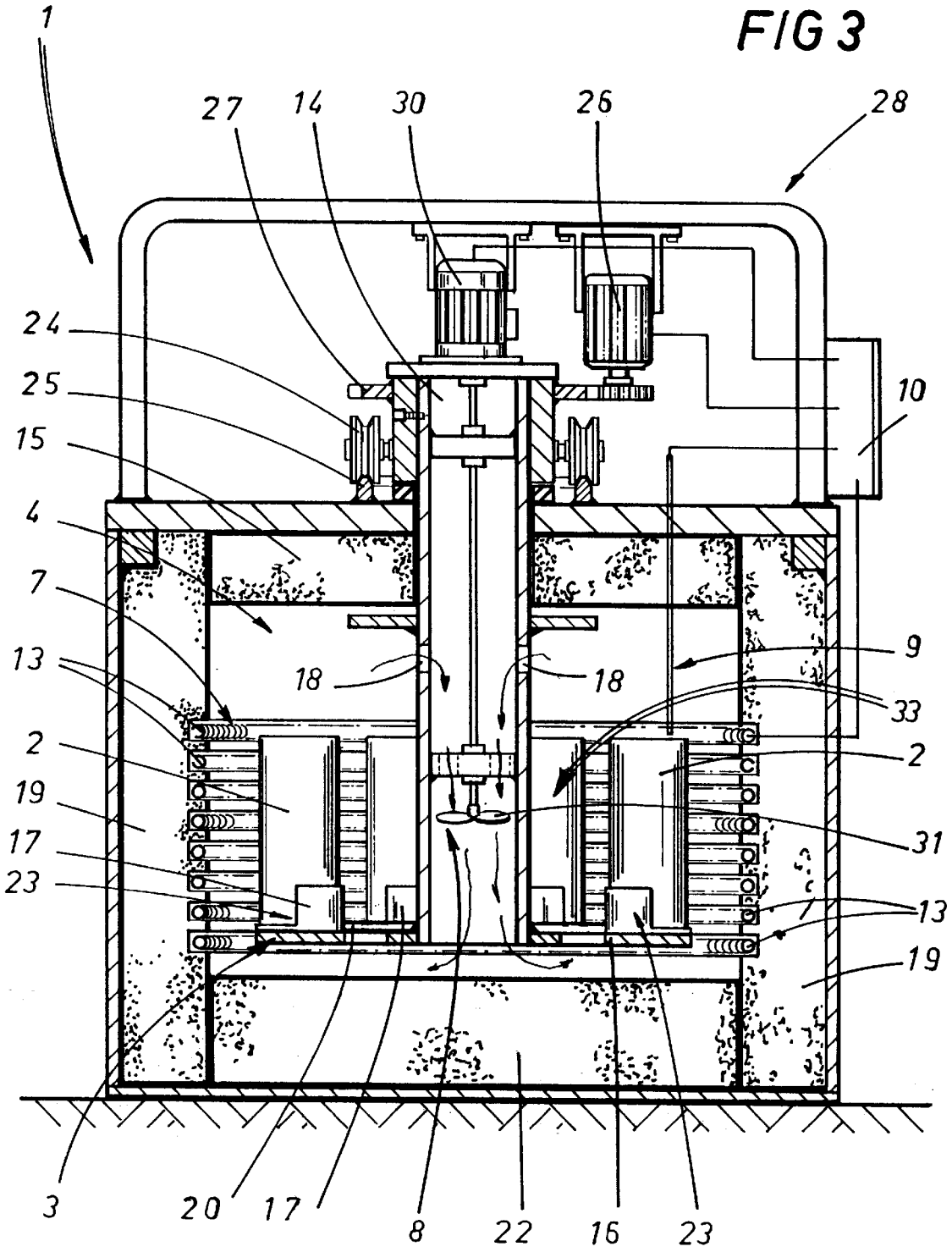
FIG. 3 illustrates a different embodiment of the equipment according to the present invention, in an axial section.

With reference to FIGS. 2, 3 and 4 of the drawings, the present invention relates to equipment capable of bringing ingots or billets or similar castings of a metal alloy, denoted 2, to the semiliquid or semisolid or plastic state; the alloy in question might be of aluminum or magnesium or copper and formulated in such a way as to respond to heat as indicated, by way purely of example, in the graph of FIG. 1.

As a first step of the method to which the present invention relates, ingots 2 in the solid state are introduced into a heat chamber 4 and exposed within the relative enclosure to convectional currents, or streams, of hot air. The ingots 2 are thus heated primarily by convection. The temperature of the solid ingots 2 at the moment of introduction into the heat chamber 4 will of course be substantially the same as the ambient temperature outside the chamber 4. Thereafter, the temperature of the alloy is monitored continuously within the chamber 4 and the ingots 2 will be removed after being heated to a predetermined temperature and held at this same temperature for a predetermined duration sufficient to induce the semisolid or semiliquid state. Inside the heat chamber 4, the ingots 2 are set in motion through the agency of conveying and positioning means 3, and transferred from an infeed zone 5 of the chamber 4 to an outfeed zone 6 of the selfsame chamber 4.

The chamber 4 might be heated by means of a fluid fuel burner 11, which also serves to generate the convectional hot air currents. The fumes produced by the burner 11 will be exhausted through vents 12 positioned above and substantially in alignment with the ingots 2.

Alternatively, the heat might be generated by a plurality of electrical resistances 13 arrayed at least along the side walls 19 of the chamber 4. The electrical resistances 13 can be made to operate selectively in such a way as to create zones of different temperature within the chamber 4, and more precisely, in such a way that the temperature gradually increases along the path followed by the ingots 2 in their progress from the infeed zone 5 to the outfeed zone 6.

The equipment capable of implementing the method according to the present invention, denoted 1 in its entirety, comprises conveying and positioning means 3 installed within and operating internally of a heat chamber 4 of which the side walls 19, the bottom wall 22 and the top wall 15 are lined with a refractory material. The ingots 2 are advanced by the conveying means 3 from an infeed zone 5 to an outfeed zone 6, both of which situated internally of the chamber 4. Ingots 2 supplied to the infeed zone 5 at ambient temperature are taken up by the conveying means 3, and removed subsequently from the equipment 1 at the outfeed zone 6 having been conditioned to the desired semisolid or semiliquid state.

The equipment comprises means 7 by which to heat the ambient air, operating within the chamber 4, and forced ventilation means 8 serving to generate convectional currents or streams of hot air which are played over the ingots 2. Also located within the chamber 4 are temperature sensing means 9 by which the temperature of the ingots 2 is monitored continuously.

The output of the temperature sensing means 9 is connected to the input of a monitoring and control unit 10 governing the operation of the equipment 1 overall. In effect, this same unit 10 controls the heating means 7, the forced ventilation means 8 and the conveying and positioning means 3. The unit 10 will be programmed in such a way that the desired temperature and timing conditions are maintained internally of the chamber 4. Timing in this context signifies the duration of the period for which the ingots 2 remain inside the chamber 4.

Observing the two embodiments of FIGS. 2, 3 and 4 in greater detail, the chamber 4 exhibits the geometry of a cylinder with a vertically disposed axis, and is compassed by side walls 19 and a bottom wall 22 combining to create a crucible substantially in the form of a bucket, also a wall uppermost acting as a lid 15. The conveying and positioning means 3 consist in a rotor 33 disposed coaxially with the chamber 4 and comprising a hollow shaft 14 that is insertable through and supported by the lid 15 in such a way as to allow rotation about its own axis. The bottom end of the hollow shaft 14 is associated with a circumferential flange 16 serving to support the ingots 2. The structure of the flange 16 can be either continuous or, preferably, discontinuous as indicated in FIG. 4, which illustrates a flange 16 embodied as a plurality of individual platforms 17 carried by respective radial arms 20 extending from the hollow shaft 14. Each platform 17 affords an arcuate element 23 serving to restrain the relative ingot 2. The hollow shaft 14 is accommodated by the lid 15 in an airtight fit and carries a plurality of freely revolving radial wheels 24, each with a peripheral groove designed to engage in rolling contact with a circular projection 25 issuing from the lid 15. The hollow shaft 14 is set in rotation about its own axis by a geared motor 26 that might be mounted to the lid 15, in a manner not shown in the drawings, and engages in mesh with a gear 27 keyed to the hollow shaft 14. The operation of the geared motor 26 is piloted by the monitoring and control unit 10.

The side walls 19 of the chamber 4 afford at least one access door 32 situated next to the infeed and outfeed zones 5 and 6. The example of FIG. 4 shows just one such access door 32, so that the positions of the infeed and outfeed zones 5 and 6 coincide. The equipment will operate in conjunction with means (not illustrated) by which to change the ingots 2, located externally of the heat chamber 4. In the embodiment of FIG. 2, the heating means 7 take the form of a fluid fuel burner 11 supported by a superstructure 28 rigidly associated with the lid 15. The flame of the burner 11 is directed down the bore of the hollow shaft 14 in such a way that the fumes emerge from the bottom end and reascend, lapping the ingots 2 supported by the platforms 17. The lid 15 affords a plurality of vents 12 located above and substantially in vertical alignment with the platforms 17, and connecting externally of the chamber 4 with an annular chamber 29 into which the fumes are channelled. The side walls 19 may also support electrical resistances 13, as illustrated in FIG. 2, designed to operate in conjunction with the burner 11.

In the solution of FIG. 3, the heating means 7 are shown as electrical resistances 13 carried at least by the side walls 19 of the heat chamber 4. In this instance, the superstructure 28 supports a motor 30 of which the function is to drive a fan 31 located near to the bottom end of the hollow shaft 14 and thus constituting the forced ventilation means 8. Whilst the lid 15 has no vents 12 in the example of FIG. 3, the hollow shaft 14 affords radial holes 18 located above the level of the fan 31 and providing air inlet ports for the forced ventilation means 8. By proportioning the output of the resistances 13 in a suitable manner and adopting an appropriate arrangement of the radial holes 18, the interior of the heat chamber 4 can be divided into different temperature zones, and more exactly, zones in which the temperature increases gradually along the path followed by the ingots 2.

Utilizing equipment 1 embodied in the manner thus described, ingots 2 are introduced singly into the chamber 4 via the access door 32, exposed to the convectional hot air currents circulated forcibly within the enclosure, heated up to a predetermined temperature and maintained at this same temperature for a given duration, then removed singly from the chamber 4 likewise via the access door 32. Clearly, a simple intervention at the monitoring and control unit 10 will serve to vary the maximum temperature at which the ingots 2 are destined to soften, and more importantly, the duration for which the ingots remain in the chamber 4. With regard in particular to the length of time the ingots 2 are kept inside the heat chamber 4, it is sufficient to adjust the speed of rotation of the hollow shaft 14.

The advantages afforded by the present invention are discernible in the constructional simplicity and compact dimensions of a practical and reliable piece of equipment 1. In particular, the expedient of the rotor 33 operating inside the heat chamber 4 is instrumental both in reducing dimensions and in allowing several ingots 2 to be heated at once.

A further advantage of the invention is reflected in the operational versatility of the equipment 1: indeed with convection as the principal means of raising temperature, it is a comparatively simple matter to heat even ingots 2 of non-cylindrical geometry, for example of square or rectangular or polygonal section. In addition, the resistances 13 can be controlled in such a way as to create zones maintained at different temperatures, so that even non-cylindrical ingots 2 can be heated correctly.

Yet another advantage of the equipment 1 is that of economy in operation, gained through the adoption of heating means 7 of a type more conventional and certainly easier to manage than induction furnaces. Also advantageous is the use of a single access door 32, as in FIG. 4, since with fewer openings in the chamber 4 there is a minimized risk that these will upset the conditions of thermal equilibrium established internally by the convectional hot air currents.

What is claimed:

1. A method for bringing metal alloy ingots, billets and the like to the semisolid or semiliquid state in readiness for thixotropic forming, comprising the steps of:

introducing the ingots in a solid state into a heat chamber;

generating heated convectional air currents internally of the chamber to flow around and heat the ingots principally by convection;

heating the ingots by the air currents to a predetermined temperature and maintaining said predetermined temperature for a predetermined time sufficient to induce the semisolid or semiliquid state of the ingots, and moving the ingots within the heat chamber between an infeed zone of the chamber at which the ingots in a solid state are introduced and an outfeed zone of the chamber from which the ingots in semisolid or semiliquid state are removed from the chamber.

2. A method as in claim 1, wherein the chamber has vents located above and substantially in vertical alignment with the ingots and the ambient air within the heat chamber is heated by a fluid fuel burner serving also to generate the convectional air currents, which are directed to flow over the ingots and toward the chamber vents allowing the release of fumes.

3. A method as in claim 1, wherein the ambient air within the heat chamber is heated by means of electrical resistances located at least along the side walls of the chamber.

4. A method as in claim 1, wherein the ambient air within the heat chamber is heated by means of electrical resistances, located at least along the side walls of the chamber producing a heat output proportioned to generate temperatures initially of different and increasing value and thereafter of identical value along the path followed by the ingots from the infeed zone to the outfeed zone to first heat the ingots to a predetermined temperature and then hold the ingots at this same temperature for a set time duration.

5. A method for bringing metal alloy ingots and billets to the semisolid or semiliquid state in readiness for thixotropic forming, comprising:

introducing the ingots in a solid state into a heat chamber;

heating the air within the chamber, generating convectional air currents in the chamber to flow over the ingots to heat the ingots by convection of the heated air;

controlling the temperature of the ingots by heating said ingots to a predetermined temperature;

maintaining the ingots at said predetermined temperature for a predetermined duration sufficient to induce the semisolid or semiliquid state of the ingots; and removing the ingots from the heat chamber.

6. A method as recited in claim 5, wherein the heat chamber has vents allowing the release of fumes, and wherein the introducing step includes positioning the ingots under and in substantially alignment with the vents, and the heating step is carried out using a fluid fuel burner, said heating also generating the convectional air currents which are directed over the ingots and toward the vents.

7. A method for bringing metal alloy ingots and billets to the semisolid or semiliquid state in readiness for thixotropic forming, comprising:

introducing the ingots in a solid state into a heat chamber, the heat chamber including an infeed zone and an outfeed zone;

heating the air within the chamber with a heating means selected from the group consisting of gas heating and electric heating;

generating convectional currents of the heated air internally of the chamber to flow over the ingots and heat the ingots principally by convection;

controlling the temperature of the heating of said ingots to a predetermined temperature and maintaining said ingots at said predetermined temperature for a predetermined time sufficient to induce the semisolid or semiliquid state of the ingots; and transferring the ingots from an infeed zone to an outfeed zone of the heat chamber during the heating that causes the ingots to change from a solid to a semisolid or semiliquid state.

8. A method as recited in claim 7, wherein the heating step is carried out by electrical heating and includes proportioning the output of the electric heating for generating temperatures initially of different and increasing value and thereafter of identical value along the path followed by the ingots from the infeed zone to the outfeed zone, whereby the ingots are first heated to a predetermined temperature and then held at this same temperature for a predetermined time duration.

9. A method for bringing metal alloy ingots and billets to the semisolid or semiliquid state in readiness for thixotropic forming, comprising:

introducing the ingots in a solid state into a heat chamber, the heat chamber including side walls, an infeed zone, an outfeed zone and vents allowing the release of fumes;

positioning the ingots under and in substantially alignment with the vents;

heating the air within the chamber by electrical resistance heaters arrayed at least along the side walls of the chamber and by a fluid fuel burner which also generates convectional air currents which are directed over the ingots and towards the vents to heat the ingots principally by convection;

controlling the temperature of the heating of said ingots to a predetermined temperature and maintaining said predetermined temperature for a predetermined duration sufficient to induce the semisolid or semiliquid state of said ingots; and transferring the ingots from the infeed zone to the outfeed zone of the heat chamber during the time of heating in said chamber that changes the ingots from a solid to a semisolid or semiliquid state.

10. A method as in claim 9, wherein the heating step by the electrical resistance includes proportioning the output of the electric resistance for generating temperatures initially of different and increasing value and thereafter of identical value along the path followed by the ingots from the infeed zone to the outfeed zone, whereby the ingots are first heated to said predetermined temperature and then held at said predetermined temperature for said predetermined duration.

11. A method as in claim 9, which comprises carrying out the steps of claim 9 in the sequence set forth in claim 9.

12. A method as in claim 1 further comprising moving said ingots within said chamber from an infeed zone to an outfeed zone during the time of heating.

13. A method as in claim 1 further comprising generating the heated convectional air currents by forced ventilation.

14. A method as in claim 5 further comprising generating the heated convectional air currents by forced ventilation.

15. A method as in claim 7 further comprising generating the heated convectional air currents by forced ventilation.

* * * * *